US009561881B2

(12) United States Patent
Schettle et al.

(10) Patent No.: US 9,561,881 B2
(45) Date of Patent: Feb. 7, 2017

(54) CYLINDRICAL CONTAINER WITH SIDE-MOUNT HANG TAB AND METHODS THEREFOR

(71) Applicant: Google Technology Holdings LLC, Mountain View, CA (US)

(72) Inventors: Adam C. Schettle, Chicago, IL (US); Umar Hanif, Chicago, IL (US); Dickon Isaacs, Chicago, IL (US); Karl Bower, Elmhurst, IL (US); Phil Hague, Chicago, IL (US); Neema Pourian, Chicago, IL (US); Zachary J. McIntosh, Chicago, IL (US)

(73) Assignee: Google Technology Holdings LLC, Mountain View, CA (US)

( * ) Notice: Subject to any disclaimer, the term of this patent is extended or adjusted under 35 U.S.C. 154(b) by 138 days.

(21) Appl. No.: 14/449,171

(22) Filed: Aug. 1, 2014

(65) Prior Publication Data

US 2016/0031603 A1 Feb. 4, 2016

(51) Int. Cl.

| | |
|---|---|
| ***B65D 79/00*** | (2006.01) |
| ***B65D 25/22*** | (2006.01) |
| ***B65D 8/00*** | (2006.01) |
| ***B31C 99/00*** | (2009.01) |
| ***B31C 5/00*** | (2006.01) |

(52) U.S. Cl.

CPC ..... *B65D 25/22* (2013.01); *B31C 5/00* (2013.01); *B31C 13/00* (2013.01); *B65D 15/02* (2013.01); *B65D 15/24* (2013.01)

(58) Field of Classification Search

CPC ..... B65D 25/22; B65D 15/02; B65D 15/24; B65D 15/04; B65D 15/12; B65D 3/04; B65D 5/4208; B65D 23/003; B65D 25/2835; B65D 33/14; B65D 45/16; B31C 13/00; B31C 5/00

USPC ..... 206/751, 752, 736, 6.1, 284, 296, 298,206/299, 301, 18, 479, 478, 806, 566, 775, 457,206/754, 459.5

See application file for complete search history.

(56) References Cited

U.S. PATENT DOCUMENTS

| | | | | | |
|---|---|---|---|---|---|
| 397,853 | A * | 2/1889 | Graham | B65D 85/40 | 206/18 |
| 1,691,937 | A * | 11/1928 | Peter | B65D 5/5038 | 206/296 |
| 2,253,212 | A * | 8/1941 | Rathbun | A45C 11/16 | 206/301 |
| 2,649,956 | A * | 8/1953 | Knibb | A44C 5/00 | 206/457 |
| 3,302,917 | A * | 2/1967 | Winkler | A47F 5/0006 | 206/806 |
| 5,372,269 | A | 12/1994 | Sutton et al. | | |

(Continued)

*Primary Examiner* — Jacob K Ackun
*Assistant Examiner* — Rafael Ortiz
(74) *Attorney, Agent, or Firm* — Faegre Baker Daniels LLP

(57) ABSTRACT

A container (100) includes a first container portion (101) and a second container portion (102). One or both can include an end member (105) and a cylindrical sidewall (103) extending from the end member. The cylindrical sidewall can include a central layer (301), an inner wrap (302), and an outer wrap (303). The central layer and the outer wrap can define one or more axially aligned apertures (304,305). A hang tab (106) defining a loop (107) and one or more socles (307,308) can be inserted through the apertures with the loop disposed exterior of the cylindrical sidewall and the one or more socles disposed between the central layer and the inner wrap.

13 Claims, 12 Drawing Sheets

(56) References Cited

U.S. PATENT DOCUMENTS

| | | | | |
|---|---|---|---|---|
| 8,899,826 | B2 * | 12/2014 | Pilz | G04B 37/1413 206/18 |
| 2004/0035725 | A1 * | 2/2004 | Smouha | A47F 7/024 206/301 |
| 2013/0320031 | A1 | 12/2013 | Rosenberg | |
| 2014/0137518 | A1 | 5/2014 | Griscik et al. | |

* cited by examiner

CYLINDRICAL CONTAINER WITH SIDE-MOUNT HANG TAB AND METHODS THEREFOR

BACKGROUND

Technical Field

This disclosure relates generally to containers, and more particularly to hanging containers.

Background Art

Many modern products are shipped in containers. Most of the containers are also intended for use as display objects on retail shelves. For example, an electronic device manufacturer will frequently place a new electronic device in a container that is shipped to the retailer. The retailer places the container on the shelf of their store. Some of the containers are quite elaborate, as marketers feel that the sensation a customer gets from "opening the box" can be as great as using the device within the box. When new products are unveiled, some people even post videos online solely to allow others to see them open the box.

Typical containers or packaging are generally in the form of a rectilinear box. The box has an opening and a planar, rectangular front face. It would be advantageous to have an improved container.

Figure 1:
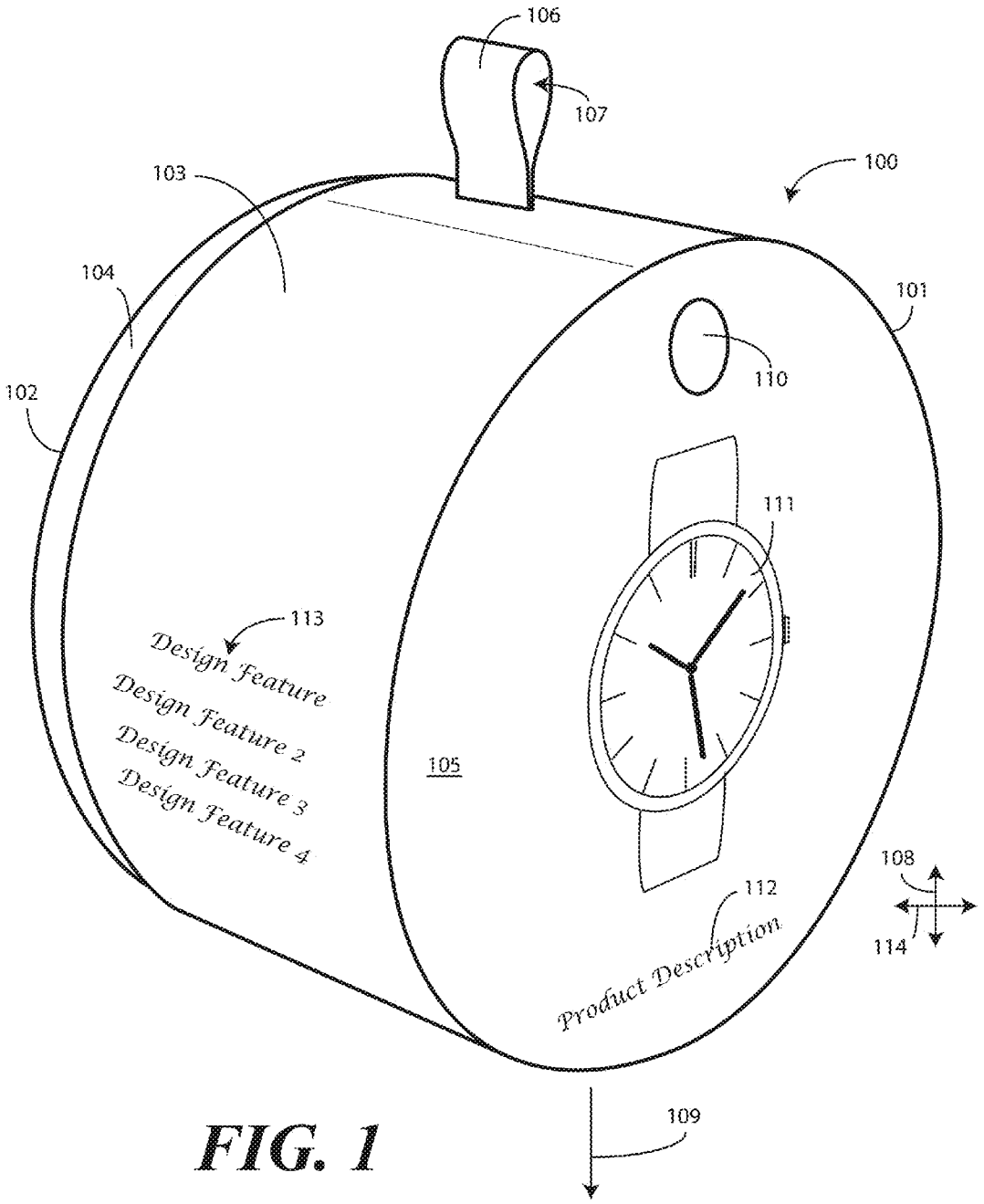
FIG. 1 illustrates one explanatory container in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Embodiments of the disclosure provide a cylindrical container for a product that includes two nested container portions. In one embodiment, each container portion includes a substantially cylindrical sidewall and a substantially planar end member. Each cylindrical sidewall extends distally from the end member and terminates to define an opening. A diameter of a first container portion is different from a diameter of a second container portion such that, when the open ends of each container portion are pushed together, the second container portion will nest within the first container portion to define a container for a product.

In one or more embodiments, the container is to store an electronic device, such as a wearable electronic device. Advantageously, the container, along with one or more inserts, is to hold a wearable electronic device within the circular opening defined by the cylindrical sidewalls. In one embodiment, the wearable electronic device can be held centered within the cylindrical sidewalls. In another embodiment, the wearable electronic device is held in an off-center orientation relative to an opening defined by the cylindrical sidewalls. In one or more embodiments, the container includes protective elements to protect surfaces of the wearable electronic device from damage during shipment and display.

The cylindrical nature of the container advantageously provides a refreshing and novel appearance to the container. This is especially true when consumers have grown accustomed to seeing nothing but rectilinear packaging. In one embodiment, the wearable electronic device stored within the container is a watch having a round dial and round case. The circular cross section of the container defined by the cylindrical sidewalls provides a mnemonic device suggesting the item stored within the container. Thus, a first to market manufacturer of, for example, a "smart watch" having a round dial and case can reinforce this fact with a round container as the packaging form factor reinforces one of the unique aspects of the product.

In one embodiment, a container portion is formed by providing a cylindrical sidewall that extends from an end member of the container portion. In one embodiment, the cylindrical sidewall comprises a central layer, an inner wrap, and an outer wrap. The central layer may be manufactured from cardboard, plastic, or other materials. The inner wrap and the outer wrap can be manufactured from paper, thermoplastics, fabrics, synthetic fibers, organic fibers, or other materials. The inner wrap and the outer wrap can be formed from the same materials, or from different materials. Further, the inner wrap and the outer wrap can have different specifications. For example, the inner wrap may be thicker than the outer wrap, or vice versa.

In one or more embodiments, it is desirable to be able to hang the container rather than placing it on a retail shelf. Advantageously, one or more embodiments of the disclosure provide a hang tab that extends from the cylindrical sidewall of a container portion to allow the container to be hung with the end portion hanging in a vertical direction when gravity acts on the container. In one embodiment, the central layer and the outer wrap define apertures that are axially aligned. A hang tab defining a loop and one or more socles can then be inserted through the axially aligned apertures such that the loop is disposed exterior of the cylindrical sidewall and the socles are disposed interior of the central layer. The inner wrap can then be applied such that the socles are disposed between the central layer and the inner wrap.

Turning now to FIG. 1, illustrated therein is one explanatory container 100 in accordance with one or more embodiments of the disclosure. The container 100 includes a first container portion 101 and a second container portion 102. A diameter of a first container portion 101 can be different from a diameter of a second container portion 102 such that, when the open ends of each container portion 101,102 are pushed together, the second container portion 102 will nest within the first container portion 101 to define a container 100 for a product. Illustrating by example, the interior diameter of the first container portion 101 may be about 130 millimeters while the interior diameter of the second container portion is about 126 millimeters. The term "about" is use to refer to a dimension inclusive of manufacturing tolerances. For example, if the manufacturing tolerances are plus or minus 0.1 millimeters, both 125.9 millimeters and 130.1 millimeters would be "about" 130 millimeters.

As shown in FIG. 1, the second container portion 102 is nested within the first container portion in this embodiment. In one embodiment, friction keeps the first container portion 101 and the second container portion 102 nested together. However, one or more mechanical retention devices can be disposed between first container portion 101 and the second container portion 102 to retain them together as well. For example, a mechanical retention device may be placed on an exterior of the cylindrical sidewall 104 of the second container portion 102, while a complementary mechanical retention device may be placed on an interior of the cylindrical sidewall 103 of the first container portion 101 to retain the two container portions together. Other techniques for retaining the first container portion and the second container portion together will be obvious to those of ordinary skill in the art having the benefit of this disclosure.

In this illustrative embodiment, each of the first container portion 101 and the second container portion 102 has an end member. The end member 105 of the first container portion 101 is visible in FIG. 1. The end member of the second container portion 102 is not visible in FIG. 1, but will be visible in subsequent figures.

In the illustrative embodiment of FIG. 1, each end member 105 is substantially planar. Advantageously, this gives the "front" of the container, which is defined by end member 105, a clean, modern, and aesthetically pleasing appearance. Moreover, as noted above, in one or more embodiments the container 100 is to house a wearable electronic device configured as a wristwatch. In one embodiment, the crystal of the wristwatch has a planar surface. Accordingly, providing an end member 105 that is planar provides a mnemonic device suggesting the shape and contours of the wearable electronic device disposed within the container 100.

It should be noted, however, embodiments of the disclosure are not so limited. The end member 105 could take any number of shapes, including parabolic shapes, circular shapes, convex shapes, concave shapes, piecewise linear shapes, or free-form shapes. Still other shapes will be obvious to those of ordinary skill in the art having the benefit of this disclosure. For example, if the wearable electronic device disposed within the container 100 had a parabolic crystal, the end member 105 could be parabolic as well. If the crystal had a Cyclops monocle, so too could the end member 105, and so forth.

In one embodiment, the cylindrical sidewall 103,104 of each of the first container portion 101 and the second container portion 102 extends distally from the respective end member. For example, in this embodiment the cylindrical sidewall 103 of the first container portion 101 extends distally from the end member 105 of the first container portion 101. The same is true for the second container portion 102 in this embodiment.

In one embodiment, a hang tab 106 extends outwardly from the cylindrical sidewall 103 of the first container portion 101 so as to define a loop 107. In one embodiment, the loop 107 has a diameter of at least 40 millimeters. In one embodiment, the diameter of the loop 107 is about 41 millimeters. Experimental testing has shown that a loop 107 of at least 40 millimeters accommodates most all hanging structures found in retail establishments.

The loop 107 is disposed exterior of the cylindrical sidewall 103 of the first container portion 101. The loop 107 defined by the hang tab 106 advantageously allows the container to hang from a peg, rod, shaft, post, or other implement to enable the container 100 to hang from the hang tab 106 with one or more of the first end member 105 of the first container portion 101 or the second end portion of the second container portion 102 oriented vertically 108 relative to the earth's surface in response to gravitational forces 109 acting on the container 100.

In one or more embodiments, one or both of the first container portion 101 or the second container portion 102 carries visual indicia disposed along an exterior surface thereof. For example, the illustrative container 100 of FIG. 1 includes branding indicia 110, a depiction 111 of the contents of the container 100, a description 112 of the contents of the container 100, and one or more descriptors 113 of the contents of the container. In one embodiment, the hang tab 106 is oriented such that any indicia disposed on the end member 105 of the container 100 is oriented vertically 108 relative to the earth's surface in response to gravitational forces 109 acting on the container 100 when it is hanging from the hang tab 106. Similarly, in one embodiment the hang tab 106 is oriented such that any indicia disposed on an exterior cylindrical sidewall 103 of the container 100 is oriented horizontally 114 relative to the earth's surface in response to gravitational forces 109 acting on the container 100 when the container 100 is hanging from the hang tab 106. The indicia of FIG. 1 are illustrative only, as other indicia will be obvious to those of ordinary skill in the art having the benefit of this disclosure.

Figure 2:
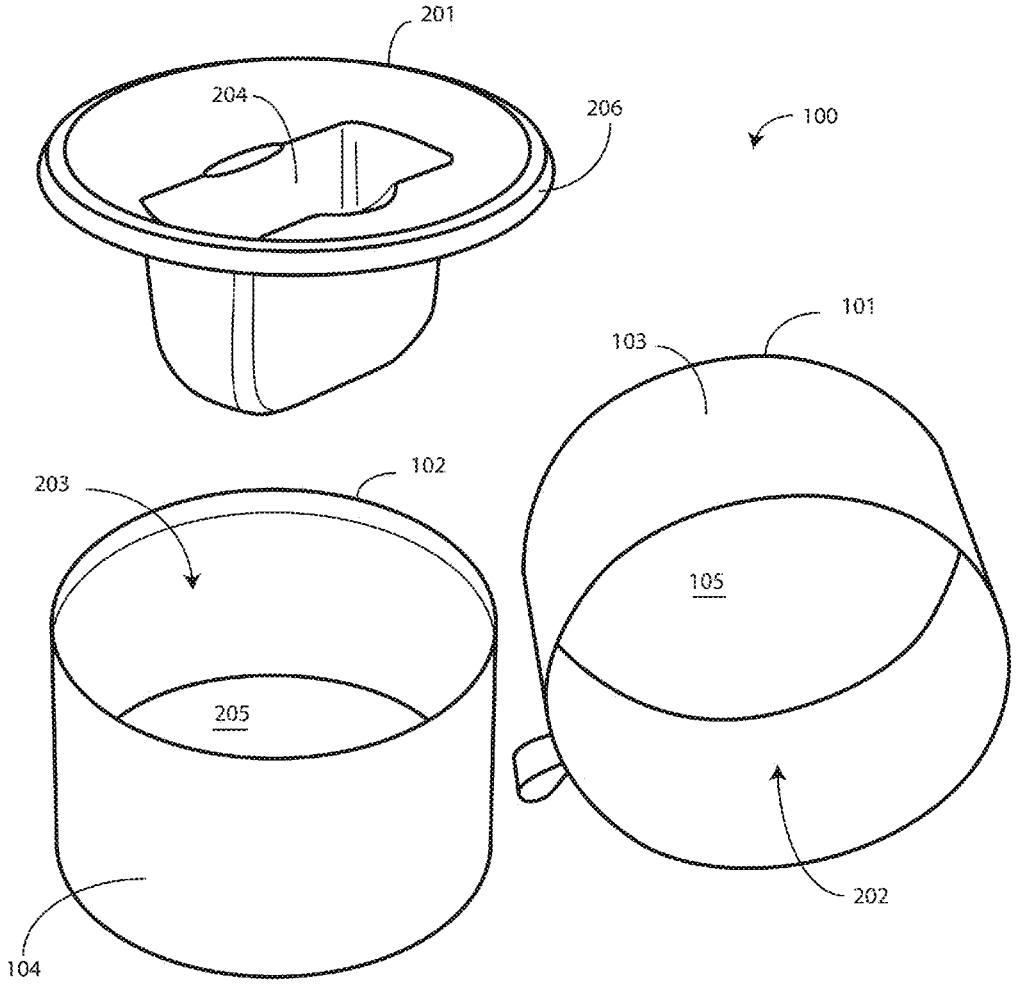
FIG. 2 illustrates an exploded view of one explanatory container in accordance with one or more embodiments of the disclosure.

Turning now to FIG. 2, illustrated therein is an exploded view of the container 100. As shown in FIG. 2, the container 100 includes the first container portion 101, the second container portion 102, and optionally one or more inserts 201. The first container portion 101 includes its end member 105 and its cylindrical sidewall 103. The cylindrical sidewall 103 extends distally from the end member 105 and terminates to define a first opening 202. Similarly, the second container portion 102 includes its end member 205 and its cylindrical sidewall 104. The cylindrical sidewall 104 extends distally from the end member 205 and terminates to define a second opening 203. When the cylindrical sidewall 104 of the second container portion 102 is inserted into the opening 202 defined by the cylindrical sidewall 103 of the first container portion 101, with the opening 203 of the second container portion oriented toward the end member 105 of the first container portion 101, the first container portion 101 and the second container portion 102 nest together.

In one embodiment, the insert 201 is inserted into the second container portion 102. The insert 201, which may be manufactured from any of plastic, paper, or other materials, may define one or more receiving surfaces 204 to receive items to be held within the container 100. In one embodiment, the insert 201 is a plastic part formed by vacuum molding. The insert 201 can include a perimeter portion 206 having a diameter that is the same as the diameter of the opening 203 of the second container portion 102 so as to be frictionally retained within the second container portion 102 after insertion. Product can be stowed atop the insert 201 while manuals or accessories can be stowed beneath the insert 201 in one or more embodiments. In other embodiments, a ledge may be provided in the second container portion 201 upon which the insert 201 rests. Either embodiment allows a user to easily remove the insert 201 to access items disposed below the insert 201.

Figure 3:
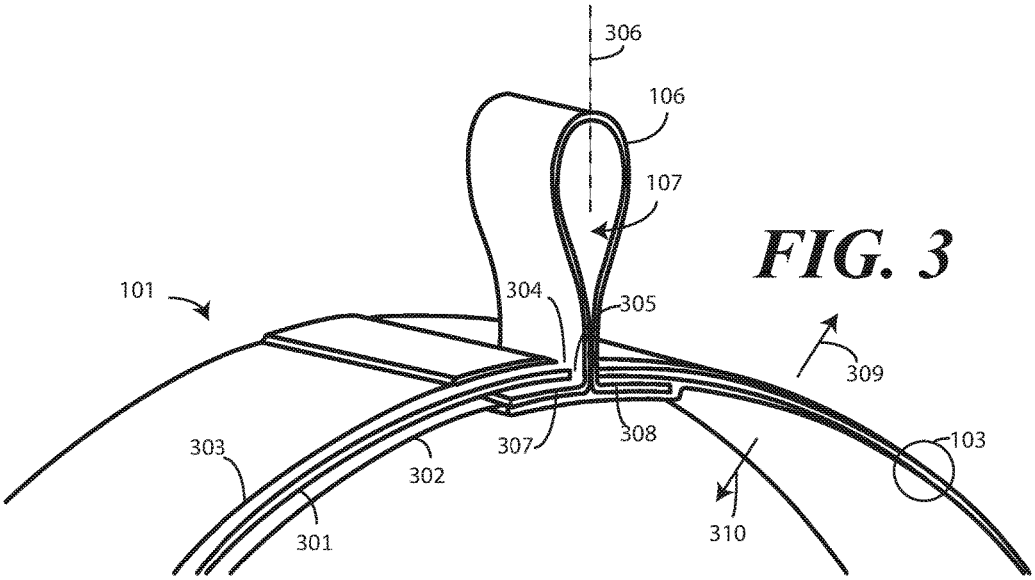
FIG. 3 illustrates a sectional view of an explanatory container portion in accordance with one or more embodiments of the disclosure.
Figure 4:
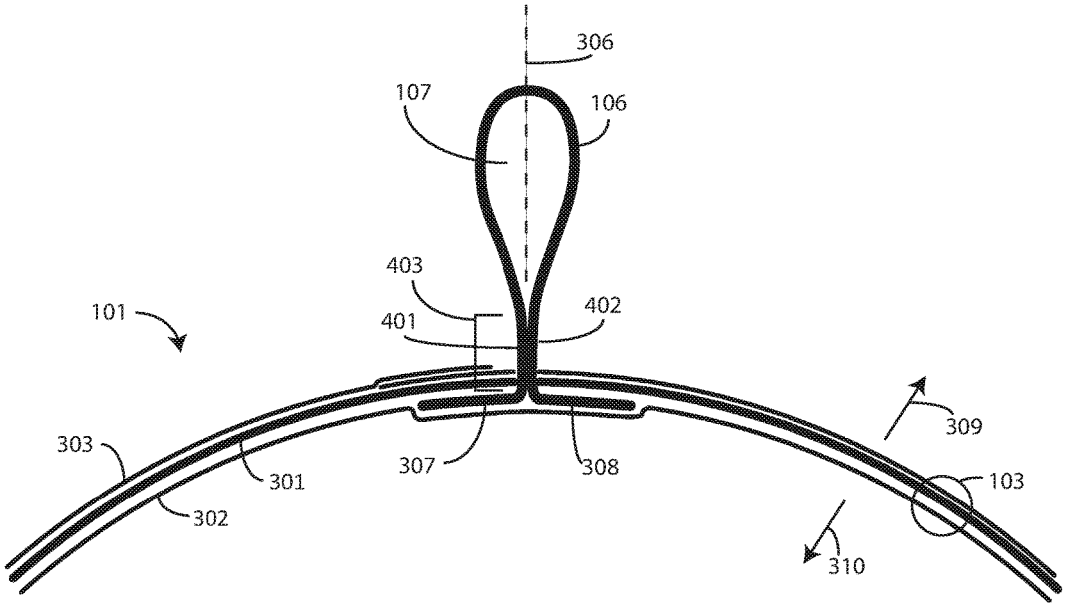
FIG. 4 illustrates another sectional view of an explanatory container portion in accordance with one or more embodiments of the disclosure.
Figure 5:
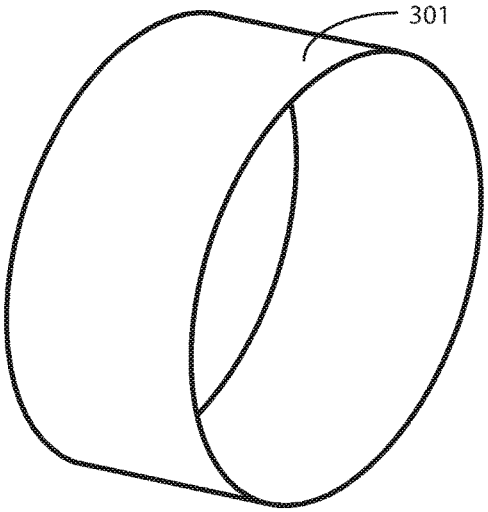
FIG. 5 illustrates an explanatory insert for a container portion in accordance with one or more embodiments of the disclosure.

Turning now to FIGS. 3 and 4, illustrated therein are sectional views of the first container portion 101 illustrating how one or more embodiments of the first container portion can be manufactured. In one embodiment, the cylindrical sidewall 103 of the first container portion 101 includes a central layer 301, an inner wrap 302, and an outer wrap 303. In one or more embodiments, one or both of the inner wrap 302 and the outer wrap 303 is adhesively attached to the central layer 301. Other attachment means, such as thermal bonding, chemical bonding, or other techniques, will be obvious to those of ordinary skill in the art having the benefit of this disclosure.

As noted above, in one embodiment the central layer 301 is manufactured from a cardboard-based material. However, in other embodiments, the central layer 301 is manufactured from a thermoplastic or other material. In one embodiment, one or both of the inner wrap 302 or the outer wrap 303 comprise a paper-based material. However, the inner wrap 302 and the outer wrap 303 could be manufactured from other materials, including thermoplastics, fabrics, synthetic fibers, organic fibers, or other materials. Where the central layer 301 is manufactured from a cardboard-based material and the inner wrap 302 and the outer wrap 303 are manufactured from a paper-based material, the central layer 301 can comprise the thickest component. Accordingly, the central layer 301 can be thicker than one or both of the inner wrap 302 or the outer wrap 303 in one embodiment.

In one embodiment, the inner wrap 302 and the outer wrap 303 are manufactured from a common material. For example, the inner wrap 302 and the outer wrap 303 can both be manufactured from paper-based materials. In another embodiment, the inner wrap 302 and the outer wrap 303 are manufactured from different materials. For example, the outer wrap 303 may be manufactured from a thermoplastic material to provide a desired sheen, while the inner wrap may be manufactured from a paper-based material to provide a desired level of matte finish.

In one embodiment, the inner wrap 302 and the outer wrap 303 are designed to different specifications. For example, in one embodiment the inner wrap 302 is thicker than the outer wrap 303. In another embodiment, the outer wrap 303 is thicker than the inner wrap 302. Other specifications could vary as well. For example, the inner wrap 302 may be water impervious, while the outer wrap 303 is not, and so forth. Other differences will be obvious to those of ordinary skill in the art having the benefit of this disclosure.

The sectional view of FIGS. 3 and 4 provides a more detailed view of the hang tab 106. In this embodiment, each of the central layer 301 and the outer wrap 303 includes an aperture 304,305. The aperture 304 of the outer wrap 303 and the aperture 305 of the central layer 301 are aligned along an axis 306 such that they are co-axially aligned relative to each other in this embodiment. When the container portion 101 is constructed, the hang tab 106 can be formed by inserting the loop portion of the hang tab through the apertures 304,305.

In this embodiment, the hang tab 106 includes one or more socles 307,308. The socles 307,308 define plinth members that serve both as a support for the loop 107 defined by the hang tab 106 and also as an attachment device to attach the hang tab 106 to the container portion 101. After the loop portion of the hang tab 106 is inserted through the apertures 304,305, the inner wrap 302 can be placed along the interior 310 of the central layer 301 such that the socles 307,308 are disposed between the central layer 301 and the inner wrap 302. The socles 307,308 can optionally be adhesively affixed to an interior of the central layer 301, an exterior of the inner wrap 302, or combinations thereof. As shown in FIGS. 3 and 4, this results in the loop 107 disposed exterior 309 of the cylindrical sidewall 103 of the container portion 101, while the socles 307,308 are disposed between the central layer 301 and the inner wrap 302 in this embodiment.

In the illustrative embodiment of FIGS. 3 and 4, the hang tab 106 if formed as a unitary strip from a unitary piece of material. In one embodiment, the unitary strip is manufactured form a polyester-based ribbon, although other materials such as nylon, thermoplastics, injection molded thermoplastics, metalized ribbons, materials comprising bendable metals or wires or other stiffeners, and so forth, can be used as well. In this embodiment, the strip is folded to define the loop 107 with a first portion 401 of the unitary strip contacting a section portion 402 of the unitary strip. The first portion 401 and the second portion 402 are coupled together in one or more embodiments. For example, the first portion 401 can be coupled to the second portion 402 by stitching, adhesives, thermal bonding, or other techniques. In FIGS. 3 and 4, the unitary strip is folded to define the loop 107 with the first portion 401 and the second portion 402 in contact so as to define a base 403 of the hang tab 106 disposed between the loop 107 and the socles 307,308.

Turning now to FIGS. 5-12, illustrated therein is a method of manufacturing the first container portion 101 in accordance with one or more embodiments of the disclosure. Beginning with FIG. 5, a central layer 301 is provided. In one embodiment, the central layer 301 is manufactured from a cardboard-based material. For example, in one embodiment the central layer 301 is manufactured from 3 millimeter caliper chip board, and has an interior diameter of about 130 millimeters. The central layer 301 can have a width of between about 69 and 70 millimeters in one embodiment.

Figure 6:
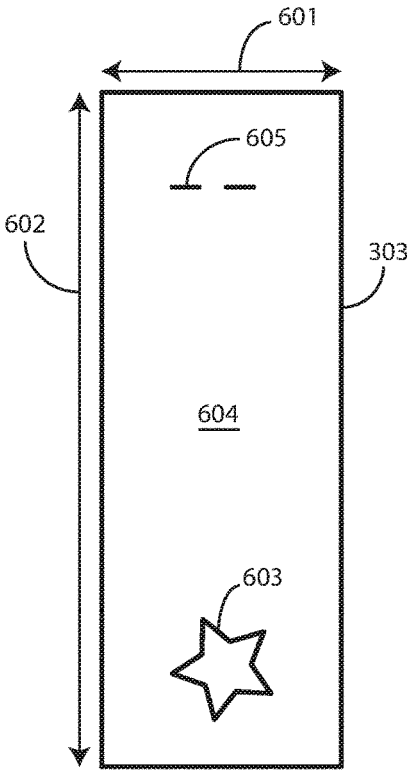
FIG. 6 illustrates an explanatory wrapping for a container portion in accordance with one or more embodiments of the disclosure.

Turning to FIG. 6, illustrated therein is one embodiment of the outer wrap 303. In one embodiment, the outer wrap 303 is manufactured from a paper-based material. For example, in one embodiment the outer wrap 303 can be manufactured from 157 GSM C2S glossy art paper. In one embodiment the outer wrap has a length 602 and width 601 that is complementary to that of the central layer (301). For example, the width 601 of the outer wrap 303 can be between about 69 and 70 millimeters, while the length 602 is about 425 millimeters so as to completely wrap about the central layer (301), providing some overlap.

In one or more embodiments, the outer wrap 303 comprises visual indicia 603 disposed along an outer surface 604 of the outer wrap 303. Examples of such visual indicia 603 include branding indicia, manufacturer indicia, or other indicia. In one or more embodiments, it is desirable to have this visual indicia 603 disposed 180 degrees about the cylindrical sidewall (103) of the resulting container portion (101) such that the visual indicia 603 is facing downward relative to the surface of the earth when the resulting container (100) is hanging from the hang tab (106) and gravitational forces (109) are acting on the container (100). Since an aperture (304) is to be punched through the outer wrap 303 in one embodiment, to ensure that the aperture (304) is created in the proper place, an alignment line 605 may be printed on the outer surface 604 of the outer wrap 303 as well such that an aperture (304) created at the alignment line 605 will be 180 degrees about the cylindrical sidewall (103) of the resulting container portion (101) from the visual indicia 603.

Figure 7:
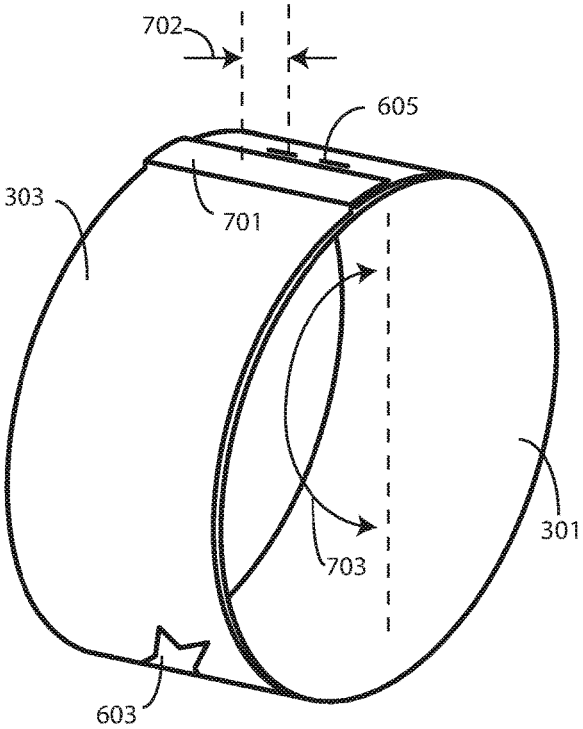
FIG. 7 illustrates an explanatory wrapped insert for a container portion in accordance with one or more embodiments of the disclosure.

Turning now to FIG. 7, as shown the outer wrap 303 has been wrapped about the central layer 301. In one embodiment, the outer wrap 303 is adhesively attached to the central layer 301. In this embodiment, the length (602) of the outer wrap 303 is sufficiently long that there is a margin of overlap 701 disposed along an exterior of the resulting structure. In this embodiment, the margin of overlap 701 is offset 702 from the alignment line 605 about which the axially aligned apertures (304,305) will be formed. As shown in FIG. 7, the visual indicia 603 are disposed 180 degrees 703 about the resulting cylindrical sidewall from the alignment line 605 in this embodiment.

Figure 8:
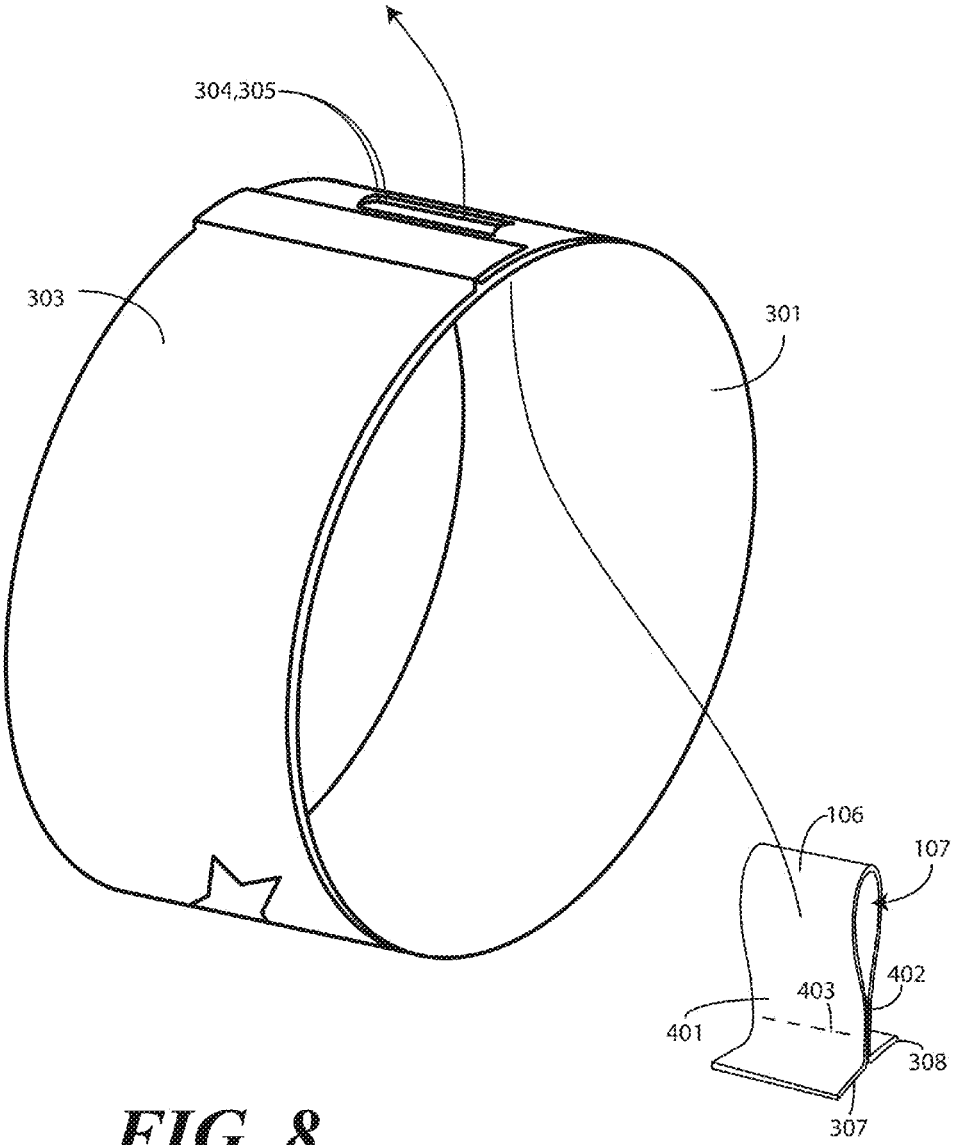
FIG. 8 illustrates a method step for assembling a hang tab into a wrapped insert for a container portion in accordance with one or more embodiments of the disclosure.
Figure 9:
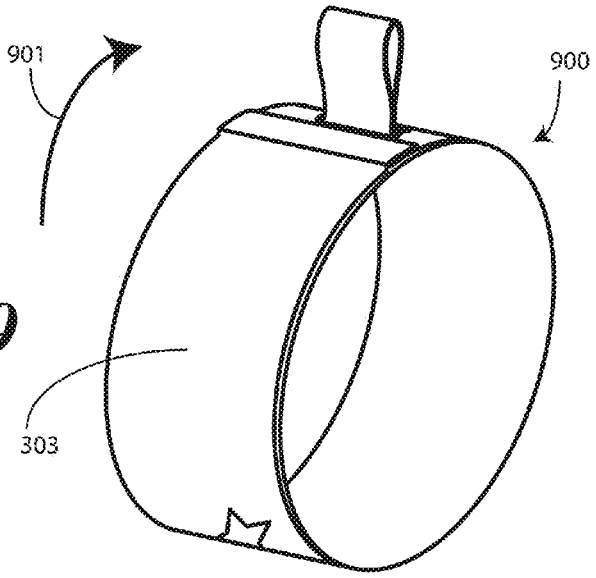
FIG. 9 illustrates the completion of the method step of FIG. 8.

Turning to FIG. 8, the apertures 304,305 have been cut through both the outer wrap 303 and the central layer 301. A unitary strip of material is used to form the hang tab, with a first portion 401 of the unitary strip connected to a second portion 402 of the unitary strip by stitching 801. The loop 107 of the hang tab 106 can then be inserted through the apertures 304,305. The socles 307,308 can then be adhesively affixed to the interior of the central layer 301 such that the loop 107 is disposed exterior of the resulting cylindrical sidewall and the one or more socles 307,308 are disposed interior to the central layer 301. The resulting structure 900 is shown in FIG. 9. Also shown in FIG. 9 is one explanatory wrapping direction 901 for the outer wrap 303 in one or more embodiments.

Figure 10:
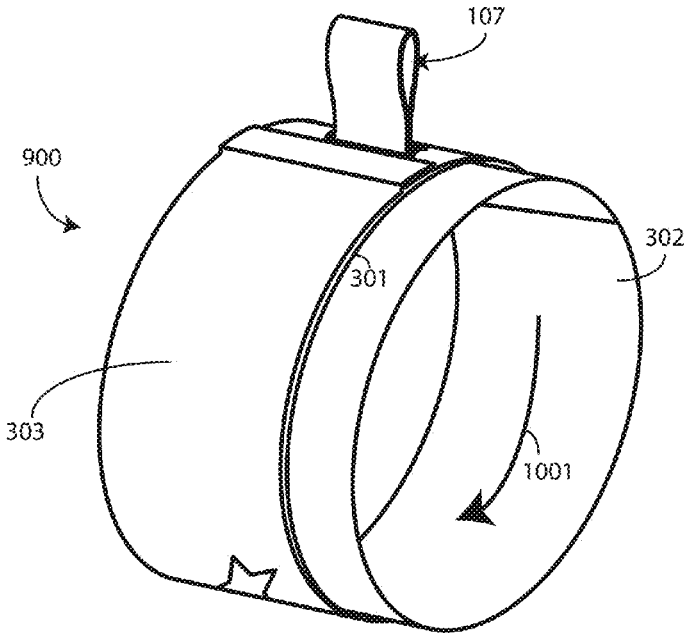
FIG. 10 illustrates another method step for assembling a container portion in accordance with one or more embodiments of the disclosure.
Figure 11:
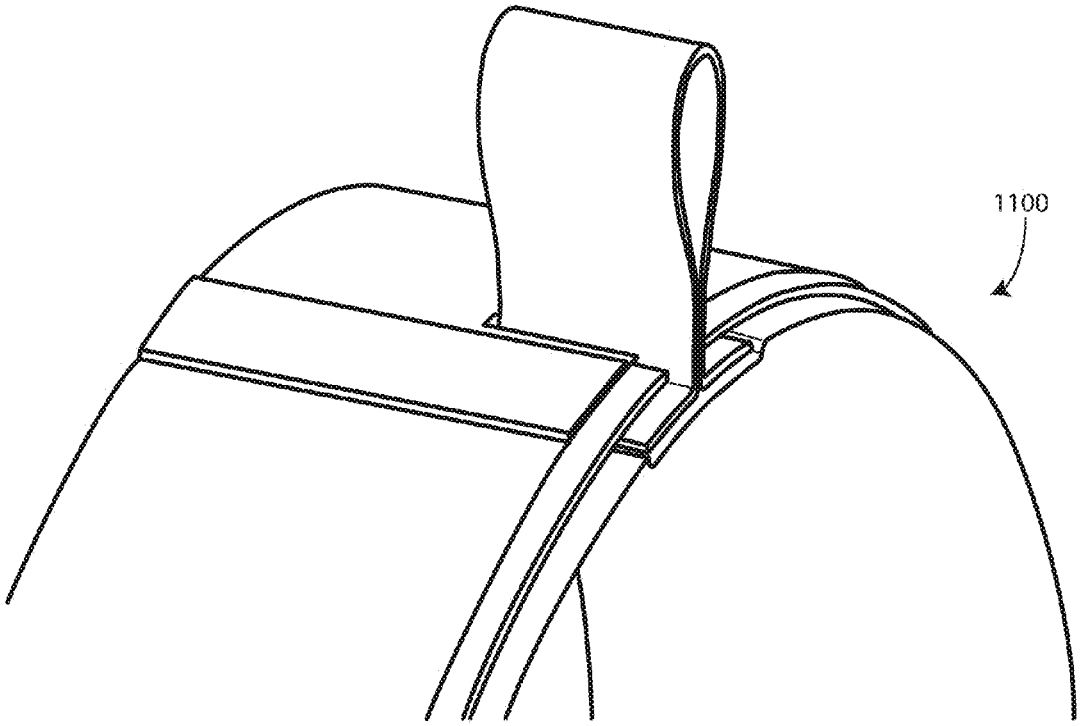
FIG. 11 illustrates an expanded, sectional view of one explanatory container portion configured in accordance with one or more embodiments of the disclosure.
Figure 12:
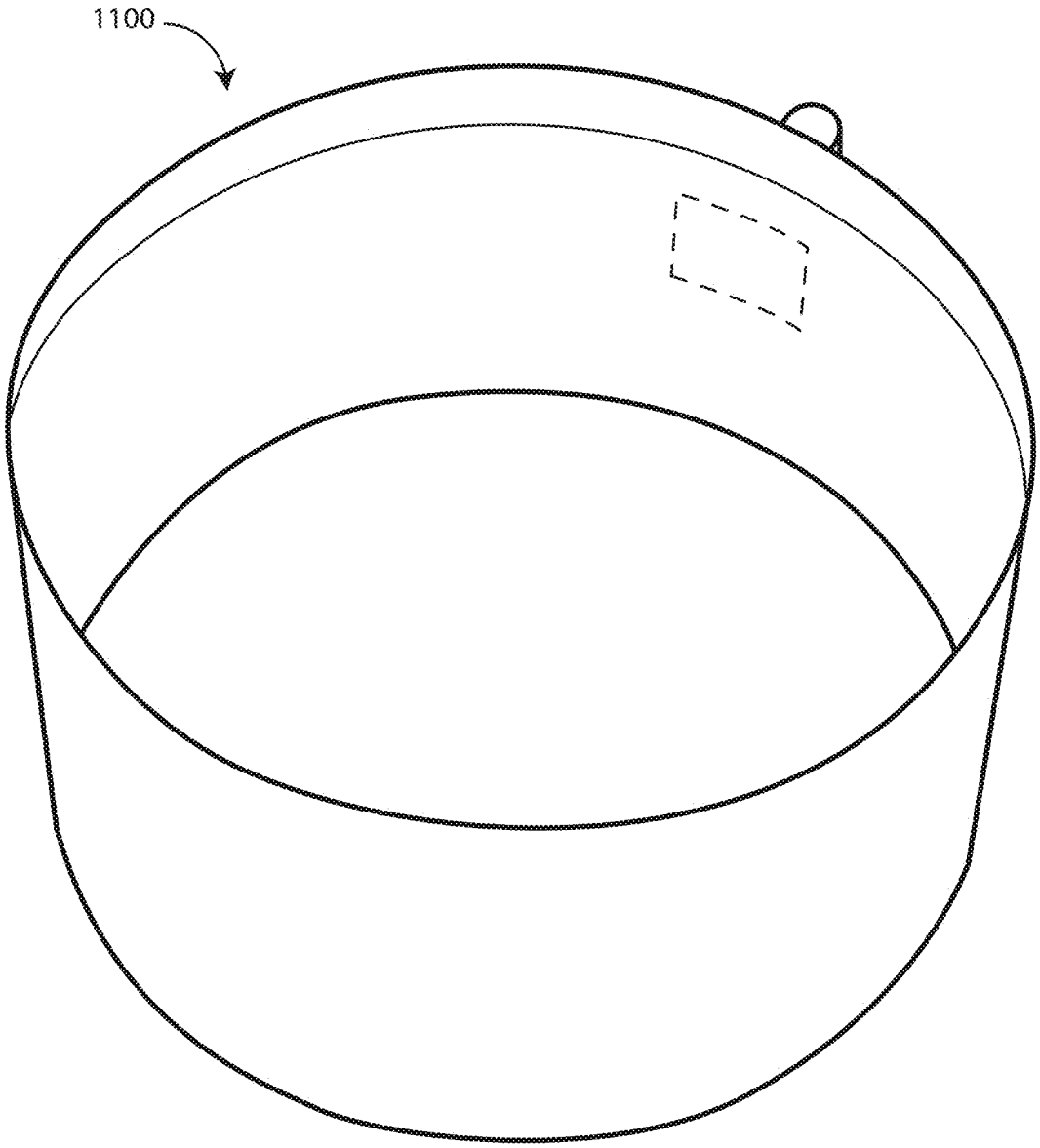
FIG. 12 illustrates an assembled container portion in accordance with one or more embodiments of the disclosure.

Turning now to FIG. 10, the inner wrap 302 can be applied to the structure 900 of FIG. 9. In one embodiment, the inner wrap 302 is applied to an interior surface of the central layer 301 with a wrapping direction 1001 that is counter to the wrapping direction (901) of the outer wrap 303. For example, while the wrapping direction (901) of FIG. 9 was clockwise, the wrapping direction 1001 of FIG. 10 is counterclockwise. This results in the loop 107 being disposed exterior of the resulting cylindrical sidewall and the one or more socles (307,308) disposed between the central layer 301 and the inner wrap 302. The resulting structure 1100 is shown in a sectional view in FIG. 11, and in a perspective view in FIG. 12.

Figure 19:
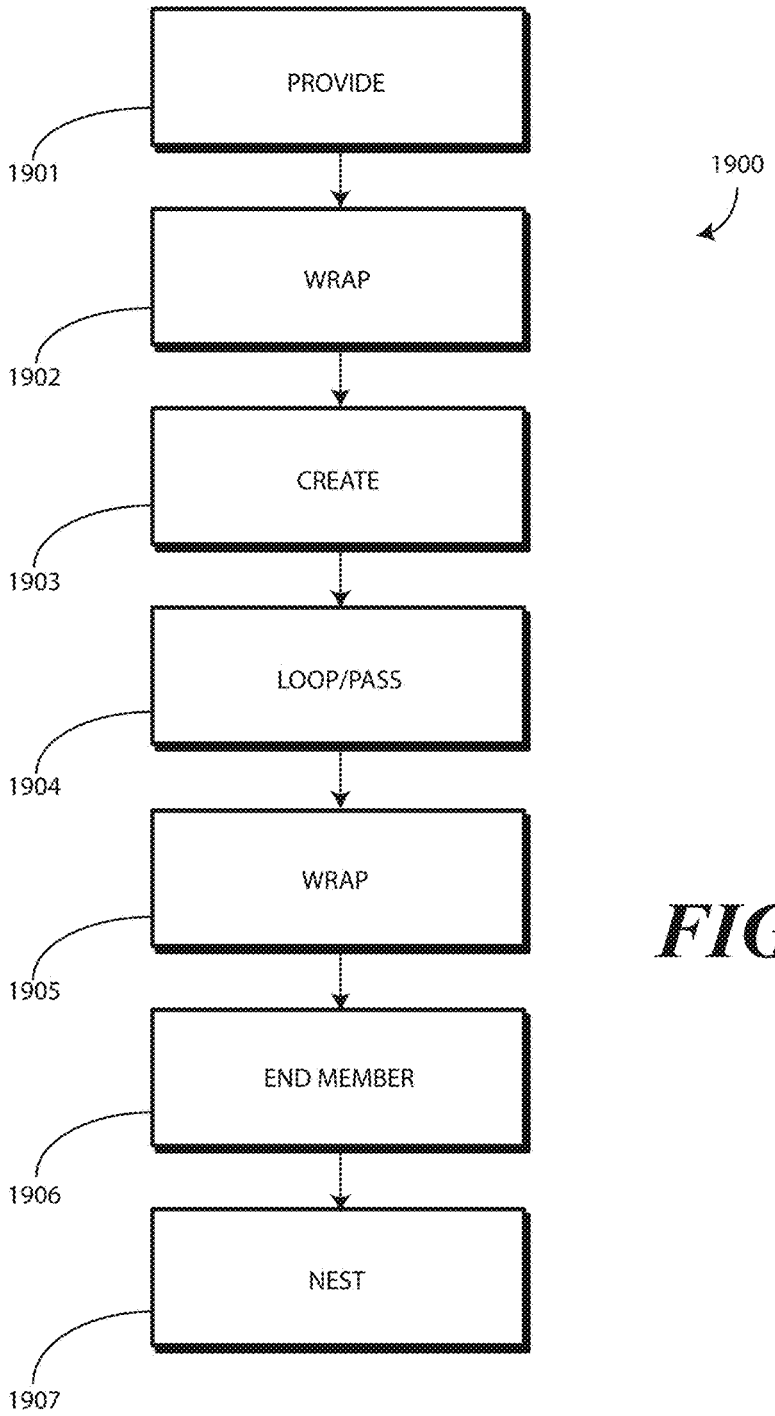
FIG. 19 illustrates an explanatory method in accordance with one or more embodiments of the disclosure.

The method shown in FIGS. 5-12 is summarized in FIG. 19. Turning briefly to FIG. 19, illustrated therein is a method 1900 of manufacturing a container portion (101) in accordance with one or more embodiments of the disclosure. The method 1900 initially provides a cylindrical central layer at step 1901. At step 1902, the cylindrical central layer is wrapped with an outer wrap. In one or more embodiments, the outer wrap comprises visual indicia and alignment line serving as an aperture demarcation. Where this is included, the wrapping of step 1902 results in the visual indicia disposed 180 degrees from the aperture demarcation when the outer wrap is disposed about the cylindrical central layer.

At step 1903, an aperture is created through both the outer wrap and the central layer. In one embodiment, step 1903 includes cutting the aperture at or about the aperture demarcation disposed along the outer wrap.

At step 1904, a loop comprising one or more socles is passed through the aperture. At step 1904, the one or more socles are optionally attached to the interior of the cylindrical central layer as well. At step 1905, an inner wrap is placed along the interior of the cylindrical central layer. At step 1906 and end member can be attached to a first opening defined by the central layer.

Steps 1901-1902 can be repeated to form a second container layer. The method 1900 can optionally then include step 1907, in which the first container portion formed by the initial iteration of steps 1901-1906 is nested with the second container portion formed by the second iteration of steps 1901,1906. In one embodiment, step 1907 comprises nesting a second container portion within a second opening defined by the cylindrical central layer to form a hanagble container.

Additional characteristics can be incorporated into containers configured in accordance with one or more embodiments of the disclosure to enhance the user experience, aid in manufacture, or for other reasons. Turning now to FIGS. 13-18, illustrated therein are a few such features.

Figure 13:
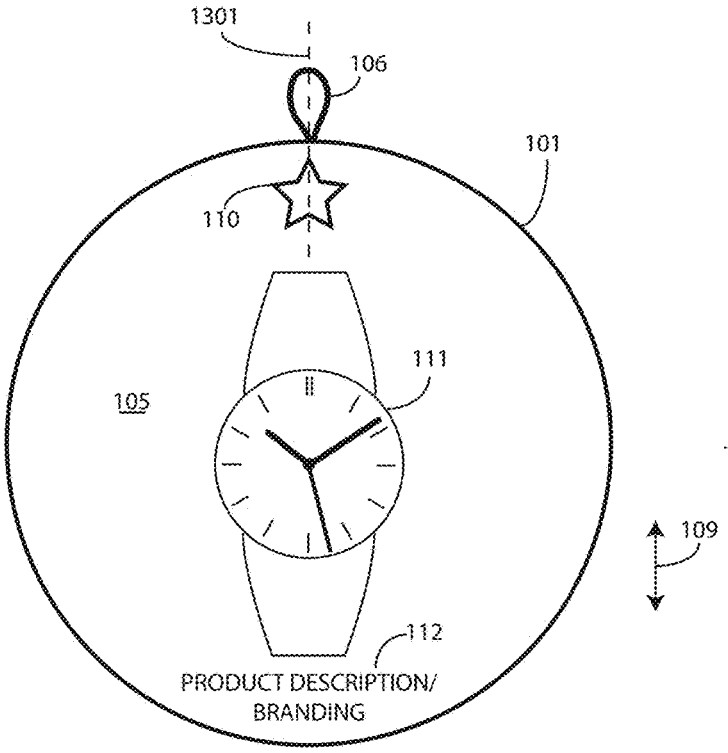
FIG. 13 illustrates an exterior front elevation view of one explanatory container portion in accordance with one or more embodiments of the disclosure.

Beginning with FIG. 13, alignment characteristics are shown. As noted above in the description of FIG. 1, in one embodiment one or both of the first container portion 101 or the second container portion (102) carries visual indicia disposed along an exterior surface thereof. For example, the exterior elevation view of the first container portion 101 shown in FIG. 13 includes branding indicia 110, a depiction 111 of the contents of the container 100, and a description 112 of the contents of the container 100. In one embodiment, it is desirable to have the hang tab 106 oriented such that this indicia disposed on the end member 105 of the first container portion 101 is oriented vertically 108 relative to the earth's surface beneath the hang tab 106 when gravitational forces (109) act on the container to which the first container portion 101 is attached when hanging from the hang tab 106.

Accordingly, in one embodiment, the method (1900) of FIG. 19 includes at step (1902) aligning the outer wrap (303) such that when the outer wrap (303) is wrapped about the central layer (301), the alignment line (605) defining where the apertures (304,305) should be cut is aligned along a vertical axis 1301 defined by an orientation of the visual indicia disposed on the end portion.

Figure 14:
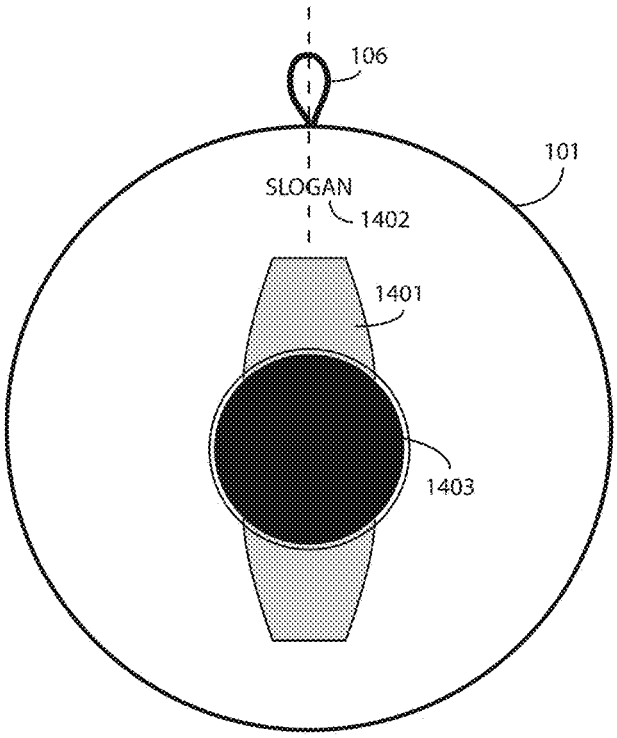
FIG. 14 illustrates an interior rear elevation view of one explanatory container portion in accordance with one or more embodiments of the disclosure.

Turning now to FIG. 14, illustrated therein is an interior elevation view of the container portion 101. As with the exterior, the container portion 101 can carry visual indicia on its interior portion as well. The explanatory visual indicia of FIG. 14 includes a silhouette 1401 of the contents that will be disposed in the container formed by the container portion 101 and a slogan 1402 to excite a user about using the contents that will be disposed in the container formed by the container portion 101. Other indicia will be obvious to those of ordinary skill in the art having the benefit of this disclosure. As with FIG. 13, in one embodiment it is desirable to have the hang tab 106 oriented such that this indicia is oriented vertically (108) relative to the earth's surface beneath the hang tab 106 when gravitational forces (109) act on the container to which the first container portion 101 is attached when hanging from the hang tab 106. Accordingly, in one embodiment, the method (1900) of FIG. 19 includes at step (1902) aligning the outer wrap (303) such that when the outer wrap (303) is wrapped about the central layer (301), the alignment line (605) defining where the apertures (304,305) should be cut is aligned along a vertical axis 1301 defined by an orientation of the visual indicia disposed on an interior of the first container portion 101.

In one or more embodiments, protective elements may be disposed along the interior of the container portion 101 to protect the contents therein. For example, as noted above in on embodiment a container (100) configured in accordance with embodiments of the disclosure is to house a wearable electronic device configured as a wristwatch. In one embodiment, to protect the crystal of the watch, a foam disc 1403 may be affixed to the interior of the first container portion 101 such that when the first container portion 101 is nested with a second container portion (102) to form the container (100). The foam disc 1403 abuts the crustal of the wristwatch. In this embodiment, the foam disc 1403 is centrally aligned within the silhouette 1401. It should be noted that where the contents of the container (100) are objects other than wristwatches, the location, placement, size, and shape of the foam disc 1403 can be altered so as to best protect that object.

Figure 15:
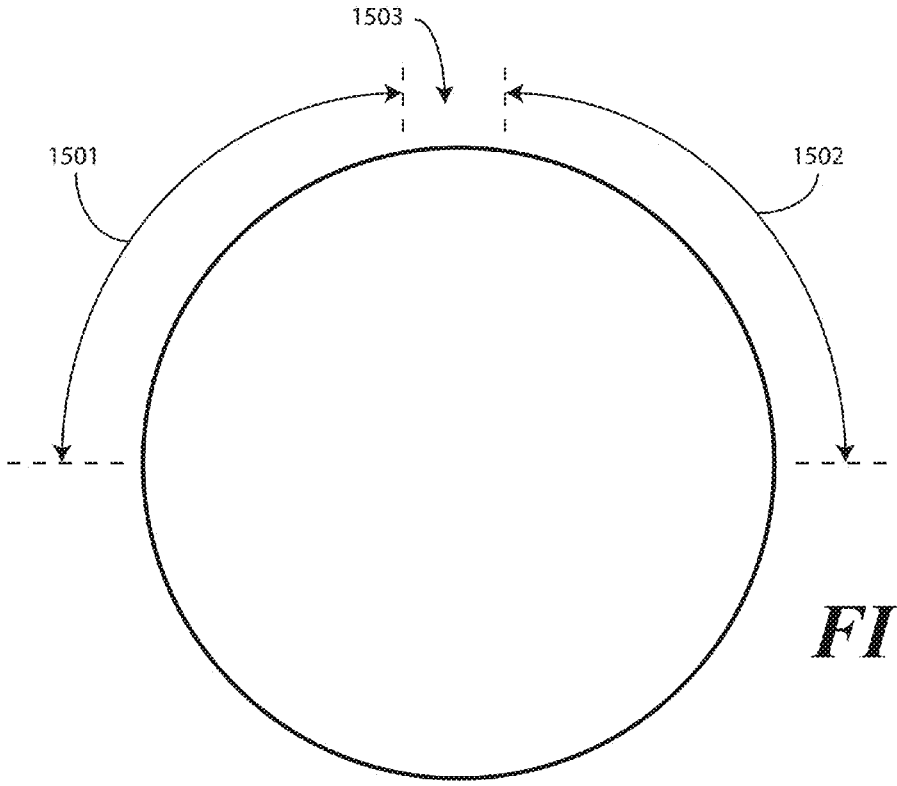
FIG. 15 illustrates an interior front elevation view of another explanatory container portion in accordance with one or more embodiments of the disclosure.

Turning now to FIG. 15, recall from the discussion of FIG. 7 that in one embodiment the length (602) of the outer wrap (303) is sufficiently long that there is a margin of overlap (701) disposed along an exterior of the resulting structure. Also recall that the margin of overlap (701) can be offset (702) from the alignment line (605) about which the axially aligned apertures (304,305) will be formed. FIG. 15 illustrates some preferred regions 1501,1502 along which the margin of overlap (701) may be located. While the location of the margin of overlap (701) is not limited to these regions 1501,1502, experimental testing has shown that placing the margin of overlap (701) in these regions 1501, 1502 provides a pleasing aesthetic appearance. Note that the regions 1501,1502 are separated by a void 1503 where the hang tab (106) will be disposed, as it is less preferable to have the apertures (304,305) disposed along the margin of overlap (701) in one or more embodiments.

Figure 16:
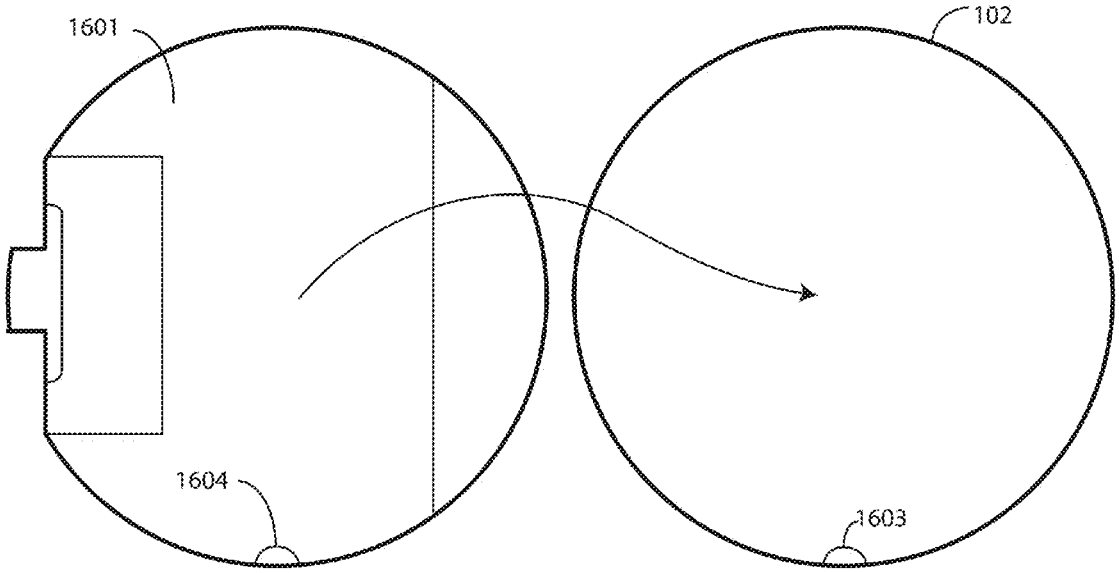
FIG. 16 illustrates a method step inserting an insert into another explanatory container portion in accordance with one or more embodiments of the disclosure.
Figure 17:
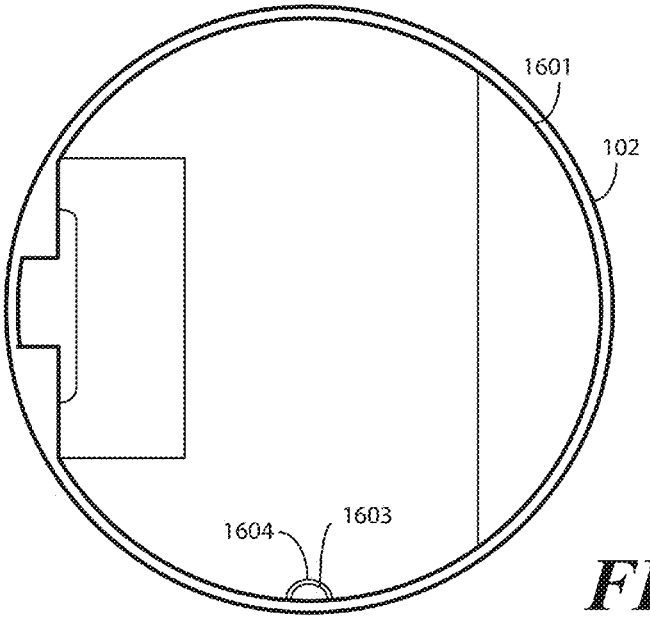
FIG. 17 illustrates another assembled container portion in accordance with one or more embodiments of the disclosure.

Turning now to FIGS. 16 and 17, recall from the discussion of FIG. 2 above that in one or more embodiments the container (100) can have an one or more inserts (201). As with the indicia of FIGS. 13-14, it can be desirable to align the insert such that the hang tab (106) is oriented with one or more products disposed within the insert oriented vertically (108) relative to the earth's surface beneath the hang tab (106) when gravitational forces (109) act on the container. The embodiment of FIGS. 16-17 provides a technique for ensuring that this occurs.

Shown in FIG. 16 are the second container portion 102 and an asymmetrical insert. To ensure that the asymmetrical insert 1602 is properly aligned within the second container portion 102, common guide devices can be disposed on the second container portion 102 and the asymmetrical insert 1602, respectively. In this embodiment, each of the second container portion 102 and the asymmetrical insert 1602 includes an alignment hole 1603,1604. As shown in FIG. 17, when the alignment holes 1603,1604 are axially aligned, proper alignment of the asymmetrical insert 1601 in the second container portion 102 is assured. The alignment holes 1603,1604 can also be used when inserts are symmetrical to ensure a proper orientation of components within the second container portion 102.

Figure 18:
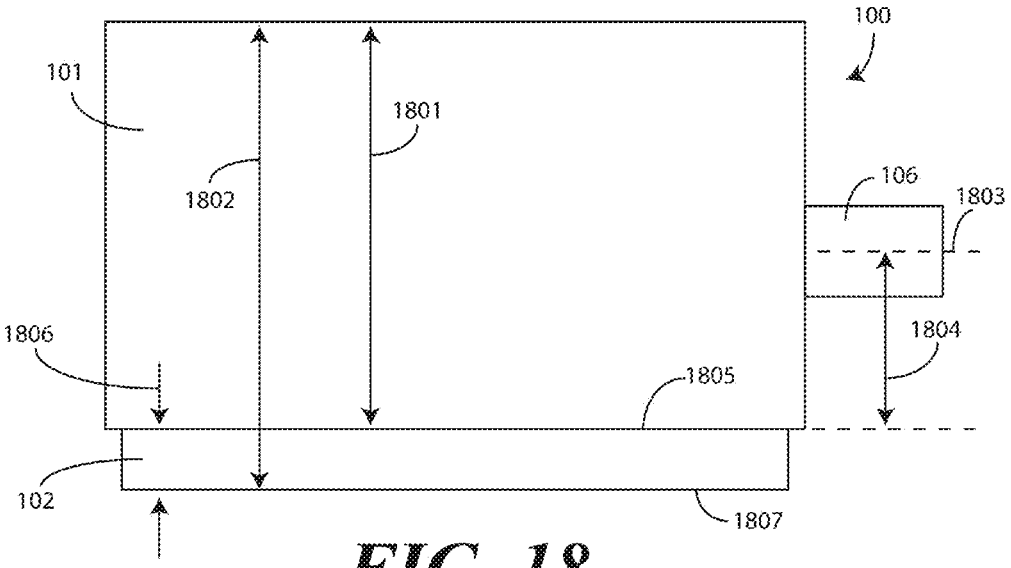
FIG. 18 illustrates a side elevation view of one explanatory container in accordance with one or more embodiments of the disclosure.

Turning now to FIG. 18, illustrated therein is a side elevation view of one explanatory container 100 configured in accordance with one or more embodiments of the disclosure. FIG. 18 is provided to show some dimensions that experimental testing has shown to work well in practice.

In one embodiment, the first container portion 101 has a thickness 1801 of between about 69 and 70 millimeters. The second container portion 102 is a bit thicker so as to protrude from the first container portion 101 when the second container portion 102 is nested within the first container portion 101. In one embodiment, the second container portion 102 has a thickness 1802 of between about 75 and 76 millimeters.

In one embodiment, to provide optimal balance, a centerline 1803 of the hang tab 106 should be disposed a distance 1804 of between about 27 and 28 millimeters from an open end 1805 of the first container portion 101. Further, a gap 1806 of about ten millimeters between the closed end 1807 of the second container portion 102 and the open end 1805 of the first container portion 101 can occur is to aid in the opening of the assembled package by providing an area for a user to grasp the second container portion 102 while removing the first container portion 101. The proportions set forth by these measurements provide an optimal balance when the container 100 is hung from the hang tab 106. While other dimensions may be used, maintaining these proportions provides an aesthetically pleasing, cylindrical container that can be hung by a cylindrical sidewall so that end members may be easily viewed.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A container portion, comprising:

an end member;

a cylindrical sidewall extending from the end member, the cylindrical sidewall comprising a central layer, an inner wrap, and an outer wrap, the central layer and the outer wrap defining axially aligned apertures; and a hang tab defining a loop and one or more socles, the loop disposed exterior of the cylindrical sidewall and the one or more socles disposed between the central layer and the inner wrap.

2. The container portion of claim 1, the end member substantially planar.

3. The container portion of claim 1, the inner wrap thicker than the outer wrap.

4. The container portion of claim 3, one or more of the inner wrap and the outer wrap comprising a paper-based material.

5. The container portion of claim 3, one or more of the inner wrap or the outer wrap adhesively coupled to the central layer.

6. The container portion of claim 3, the central layer thicker than the inner wrap.

7. The container portion of claim 6, the central layer comprising a cardboard-based material.

8. The container portion of claim 1, the one or more socles adhesively coupled to an interior of the central layer.

9. The container portion of claim 1, the outer wrap comprising visual indicia disposed along an outer surface of the outer wrap, the visual indicia disposed 180 degrees about the cylindrical sidewall from the hang tab.

10. The container portion of claim 1, the hang tab comprising a unitary strip folded to define the loop with a first portion of the unitary strip contacting a second portion of the unitary strip to define a base disposed between the one or more socles and the loop.

11. The container portion of claim 10, the first portion and the second portion coupled together by stitching.

12. The container portion of claim 10, the unitary strip comprising a polyester-based ribbon.

13. The container portion of claim 10, the loop having a diameter greater than 40 millimeters.

* * * * *